United States Patent [19]

Kiyono et al.

[11] Patent Number: 4,796,591

[45] Date of Patent: Jan. 10, 1989

[54] INTERNAL COMBUSTION ENGINE CONTROL SYSTEM

[75] Inventors: Masashi Kiyono, Anjo; Tomoaki Abe, Obu; Mitsunori Takao, Kariya, all of Japan

[73] Assignee: Nippondenso Co., Ltd., Kariya, Japan

[21] Appl. No.: 87,031

[22] Filed: Aug. 19, 1987

[30] Foreign Application Priority Data

Sep. 3, 1986 [JP] Japan ..... 61-208356
Sep. 4, 1986 [JP] Japan ..... 61-208619
Sep. 8, 1986 [JP] Japan ..... 61-211270

[51] Int. Cl.[4] ..... F02M 51/00; F02D 41/10

[52] U.S. Cl. ..... 123/492; 123/494; 123/488; 123/589

[58] Field of Search ..... 123/478, 480, 488, 489, 123/492, 493, 494, 585, 589, 454; 364/431.05

[56] References Cited

U.S. PATENT DOCUMENTS

| | | | |
|---|---|---|---|
| 3,975,951 | 8/1976 | Kohama et al. | 73/116 |
| 4,096,833 | 6/1978 | Sweet | 123/488 |
| 4,121,545 | 10/1978 | Mizote | 123/488 X |
| 4,301,779 | 11/1981 | Hufton | 123/478 |
| 4,421,089 | 12/1983 | Moore, Jr. | 123/454 |
| 4,490,792 | 12/1984 | Deutsch et al. | 364/431.07 |
| 4,499,881 | 2/1985 | Takao | 123/492 |
| 4,527,529 | 7/1985 | Suzuki et al. | 123/478 |
| 4,565,091 | 1/1986 | Ito et al. | 73/118 |
| 4,586,479 | 5/1986 | Isomura et al. | 123/492 |
| 4,596,138 | 6/1986 | Ito et al. | 73/118 |
| 4,600,993 | 7/1986 | Pauwels et al. | 123/488 X |
| 4,612,894 | 9/1986 | Satoh et al. | 123/494 |
| 4,616,621 | 10/1986 | Kuroiwa et al. | 123/488 X |
| 4,664,090 | 5/1987 | Kabasin | 123/494 |

FOREIGN PATENT DOCUMENTS

| | | |
|---|---|---|
| 0057029 | 5/1979 | Japan . |
| 0107925 | 8/1981 | Japan . |
| 0091343 | 6/1982 | Japan . |

*Primary Examiner*—Willis R. Wolfe
*Attorney, Agent, or Firm*—Cushman, Darby & Cushman

[57] ABSTRACT

Disclosed in an internal combustion engine control system for controlling at least one of the quantity of intake air and quantity of fuel supply, and to an internal combustion engine control system for controlling the air-fuel ratio of the mixture. The invention particularly relates to the control of the engine at a transition of operating condition. The former control system detects the change in one of the quantity of intake air and quantity of fuel supply and compensates the other, thereby controlling the engine by anticipation at a transition of control condition. The latter control system, as a first case, infers the mixture air-fuel ratio contributive to combustion so as to adjust fuel supply to the cylinder which is currently in the suction stroke, or, as a second case, infers the mixture air-fuel ratio in the same way as above so as to adjust the quantity of air taken in the cylinder which is currently in the suction stroke, both cases implementing the anticipation control so that the mixture air-fuel ratio is maintained within the prescribed range.

16 Claims, 16 Drawing Sheets

INTERNAL COMBUSTION ENGINE CONTROL SYSTEM

BACKGROUND OF THE INVENTION

1. Field of the Invention

This invention relates to an internal combustion engine control system, and more particularly to an internal combustion engine control system which controls at least one of the quantity of intake air and quantity of fuel supply to the engine and further controls the air-fuel ratio of the mixture.

2. Description of the Related Art

Electronic control for internal combustion engines is prevailing recently. Various types of controllers have been proposed with the intention of controlling at least one of the fundamental controlled variables of the internal combustion engine, i.e., the quantity of intake air or fuel supply, in accordance with the operational state of the engine, as described for example in Japanese Patent Unexamined Publication No. 56-107925. These engine controllers, when employing the air priority system in which the throttle valve opening is determined by the depth of accelerator operation, implement synchronous fuel injection with the quantity of fuel being determined properly basing on the quantity of intake air, engine coolant temperature and intake air temperature, and also modify the quantity of fuel injection or increase the fuel supply by asynchronous fuel injection depending on the operating condition. These modification operations take place at transitional events of engine operation such as an increased power demand at starting of the vehicle with its closed throttle valve being operated to open, recovery from the fuel-cut condition, and activation of the air conditioner. Even the fuel priority system determines the quantity of fuel supply first, and it also implements various modifications by anticipation of a possible transitional change in the engine operating condition.

There are also proposed several control system with the intention of enhanced exhaust detoxification and fuel economy by controlling the air-fuel ratio. Such engine control systems normally operate to detect the quantity of intake air to the engine and determine from it the quantity of fuel to be injected, and also control the quantity of fuel injection depending on the exhaust composition (generally the oxygen concentration in the exhaust gas is detected), thereby maintaining the intended air-fuel ratio, e.g., the stoichiometric air-fuel ratio (A/F $\approx$15) or the lean air-fuel ratio, associated with the specific engine operating condition, as described for example in Japanese Patent Unexamined Publication No. 54-57029.

However, the first-mentioned engine control systems which control at least the quantity of intake air and quantity of fuel supply implement modification for the controlled variable, i.e., quantity of air or fuel, on an inference basis to some extent at a transition, and therefore the modification does not always provide the expected result or even deteriorates the operational characteristics when adverse conditions arise coincidently or due to the disparity of quality and aging of component parts.

Also in the second-mentioned engine control system which controls the air-fuel ratio, the controlled variable could deviate from the intended air-fuel ratio at a transition of load condition or the like due to the delay from a change in the quantity of intake air until the quantity of fuel to be injected is calculated or the delay in detecting the oxygen concentration in the exhaust (after air intake, the engine operates for the compression stroke and combustion stroke before the oxygen concentration is measured in the exhaust). To cope with this matter, there has been proposed a control system which performs asynchronous fuel injection to modify the air-fuel ratio by anticipation, thereby improving the control response. Even in this case, the result of control appers in the exhaust after the engine has operated for the compression and combustion strokes, and it is finally detected in the exhaust stroke as a change in the oxygen concentration, thus giving rise to the same problem as in the case of the first-mentioned engine control systems.

For example, in the engine control system designed such that when the vehicle driver has applied the accelerator to race the engine from its idling state, the idle switch is operated by the opening throttle valve to increase the fuel by asynchronous fuel injection in anticipation of start-up, the fuel supply is increased as specified even if the throttle opening is little and, therefore, the amount of intake air does not change significantly, resulting in an excessively rich air-fuel ratio. In consequence, the engine output falls, and this can incur engine stall in the worst case. The same impropriety arises at asynchronous fuel injection when the vehicle is accelerated or it is restored from fuel-cut. Even with much ingeneous engine control which responds proportionally to events, it is difficult to completely get rid of the above-mentioned problems so far as there exist mechanical errors and disparities in the fuel injection valve, intake air metering device and idle switch.

In addition, the engine control system which controls the air-fuel ratio further have the following problems. Recent fuel injection control for internal combustion engines is elaborate and it employs a microcomputer to perform interrupt control for asynchronous fuel injection, fuel-cut, and the like depending on various conditions, thereby maintaining the quantity of fuel appropriately relative to the quantity of intake air. At the same time various electrical appliances including an air conditioner are often installed in the vehicle, causing the engine to operate in a wider range of condition and under a variety of combination of individual conditions. The failure of a sensor for detecting the engine operational state or its erroneous detection can present an operational state which would never occur usually. Although counter measures are taken against these cases, the air-fuel ratio can be unbalanced significantly on occasions of the specific combination of engine operating condition and the disparity and change by aging of component parts, which eventually incurs engine troubles such as engine stall.

SUMMARY OF THE INVENTION

An object of this invention is to solve the aforementioned problem of inference control arising at the transition of the engine operating condition, and to provide a control system for an internal combustion engine capable of maintaining the mixture air-fuel ratio within the prescribed range in any engine operating condition.

According to a first aspect of this invention, the engine control system comprises means for detecting the value of a controlled variable which is one of the quantity of intake air and quantity of fuel supply to the engine, means for controlling the air-fuel ratio which determines the base value of the controlled variable for use in controlling the other controlled variable basing on the detected controlled variable, means for detecting the transition of the engine operating condition, means for determining the value of modification for the determined base control value, and means for compensating the first-mentioned controlled variable in accordance with the determined modification value.

In this engine control system, when employing the air priority system in which the controlled variable detecting means measures the quantity of intake air and the air-fuel ratio control means determines the base fuel quantity depending on the detected quantity of air, the value of modification for the base fuel quantity is determined by the modifying means in response to the transition of engine operating condition detected by the transition detecting means, and the value of modification is further used to modify the quantity of intake air. On the other hand, the engine control system employing the fuel priority system in which the base air quantity is determined from the quantity of fuel supply, the fuel quantity is modified basing on the value of modification for the intake air by the compensating means. The controlled variable detecting means is a device for measuring the intake air in the case of the air priority system, while it is a device for measuring the fuel supply in the case of the fuel priority system. The air-fuel ratio control means uses the control value measured by the controlled variable detecting means for determining the base value in controlling the other controlled variable, and the base value is generally determined to produce the intended mixture air-fuel ratio or to achieve the air-fuel ratio in the intended range.

According to a second aspect of this invention, the engine control system is used for controlling the air-fuel ratio of the mixture supplied to an internal combustion engine, and it comprises means for supplying the fuel to the engine, means for inferring the quantity of air taken in a cylinder of the engine, means for inferring the quantity of fuel delivered to the cylinder, means for inferring the air-fuel ratio of the mixture in the cylinder basing on the inferred quantities of air and fuel, and means for operating on the fuel supply means in accordance with the inferred air-fuel ratio to modify the quantity of fuel delivered to the cylinder so that the air-fuel ratio is maintained within a prescribed range.

This engine control system is used for an internal combustion engine having fuel injection control, and it operates such that the air inferring means infers the quantity of air taken in the cylinder, the fuel inferring means infers the quantity of fuel delivered to the cylinder, and the air-fuel ratio modifying means operates on the fuel supply means in accordance with the inferred air-fuel ratio provided by the air-fuel ratio inferring means as evaluated from the inferred quantities of air and fuel to modify the quantity of fuel delivered to the cylinder so that the mixture air-fuel ratio is maintained within a prescribed range.

According to a third aspect of this invention, the engine control system is used for controlling the air-fuel ratio of the mixture supplied to an internal combustion engine, and it comprises means for varying the quantity of intake air, means for inferring the quantity of air taken in a cylinder of the engine, means for inferring the quantity of fuel delivered to the cylinder, means for inferring the air-fuel ratio of the mixture in the cylinder basing on the inferred quantities of air and fuel, and means for operating on the air varying means in accordance with the inferred air-fuel ratio to modify the quantity of intake air to the cylinder so that the air-fuel ratio is maintained within a prescribed range.

This engine control system is used for an internal combustion engine having fuel injection control, and it operates such that the air inferring means infers the quantity of air taken in the cylinder, the fuel inferring means infers the quantity of fuel delivered to the cylinder, and the air-fuel ratio modifying means operates on the air varying means in accordance with the inferred air-fuel ratio provided by the air-fuel ratio inferring means as evaluated from the inferred quantities of air and fuel to modify the quantity of air taken in the cylinder so that the air-fuel ratio is maintained within a prescribed range.

DESCRIPTION OF THE PREFERRED EMBODIMENTS

Embodiments of this invention will now be described with reference to the drawings. Initially, the arrangement of the inventive internal combustion engine control system including an engine and an electronic control unit will be explained using FIGS. 1 and 2.

Figure 1:
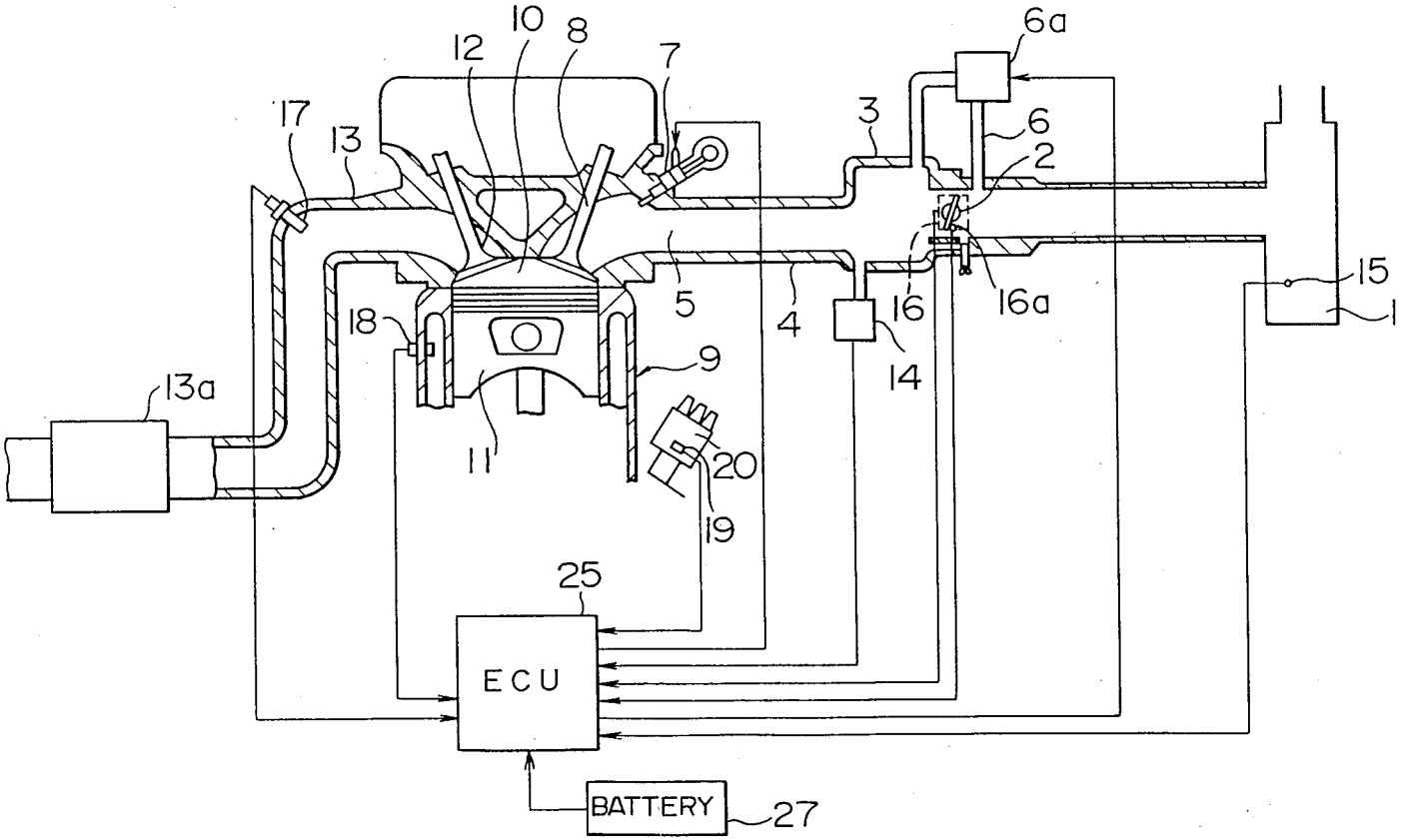
FIG. 1 is a diagram showing in block diagram the engine control system and the structure of the internal combustion engine implicated in the control system.

In FIG. 1, intake air supplied to the engine is introduced through an air cleaner 1, its flow rate is controlled by a throttle valve 2 which is operated by the driver through the accelerator pedal, and the air is conducted through a surge tank 3 and intake pipe 4 to an intake port 5. The air intake system has a by-pass 6 which shunts the throttle valve 2, and a motor-driven air control valve 6*a* for controlling the flow rate in the by-pass 6 is provided midway on the by-pass 6. The air control valve 6*a* is normally used for controlling the engine idling speed by regulating the quantity of intake air into the engine, and in this embodiment of the invention it is further used to adjust the quantity of intake air during the engine operation with the throttle valve 2 being open. The function of the air control valve 6*a* will be described later.

Provided on the intake pipe 4 is a fuel injection valve 7, which is supplied with the fuel from a fuel tank through a fuel pipe. A pressure regulator is provided midway on the fuel pipe so that the fuel pressure is kept constant. When a voltage pulse is applied to the fuel injection valve 7, it opens to inject a certain amount of fuel, accurately proportional to the effective injection pulse width t, into the intake port 5. The air-fuel mixture produced in the intake port 5 is conducted by way of an intake valve 8 into the combustion chamber 10 of the engine 9 and it is ignited by the spark at the proper timing. The combustion chamber 10 is blocked by a moving piston 11, and the exhaust gas produced as a result of combustion of the mixture is discharged to the atmosphere by way of an exhaust valve 12, exhaust pipe 13 and catalytic converter 13*a*.

The engine 9 is provided with various sensors for detecting its operational state, and they include an intake pipe pressure sensor 14, intake temperature sensor 15, throttle position sensor 16, air-fuel ratio sensor 17, coolant temperature sensor 18, and crank angle sensor 19.

The intake pipe pressure sensor 14, which is a kind of semiconductor pressure sensing device, is located in the surge tank 3, and it detects the intake pipe pressure Pm and produces an analog signal accordingly. The intake temperature sensor 15 is located in the air cleaner 1, and it provides an analog signal representing the intake air temperature Tam. The throttle position sensor 16 is linked to the rotational shaft of the throttle valve 2, and it provides an analog signal representing the opening $\theta$ of the throttle valve 2. The throttle position sensor 16 incorporates an idle switch 16*a*, which produces an ON or OFF signal in correspondence to the full closed or non-full closed position, respectively, of the throttle valve 2. The air-fuel ratio sensor 17 is located in the exhaust pipe 13, and it provides an analog signal indicative of the residual oxygen concentration $\lambda$ in the exhaust gas. The coolant temperature sensor 18 is located in the water jacket of the engine 9, and it provides an analog signal representing the engine coolant temperature Thw. The crank angle sensor 19 is disposed to confront the ring gear formed on the shaft of the distributor 20 which is coupled with the crankshaft of the engine 9, and it produces a pulse signal at a certain interval of the crank angle.

These sensors are connected electrically to an electronic control unit (will be termed "ECU") 25 which controls the quantity of fuel injection to the engine. The ECU 25 powered by a battery 27 receives the signals from all sensors and operates on the fuel injection valve 7 in accordance with the predetermined procedure to inject a certain amount of fuel depending on the quantity of intake air which is determined by the opening of the throttle valve 2.

Figure 2:
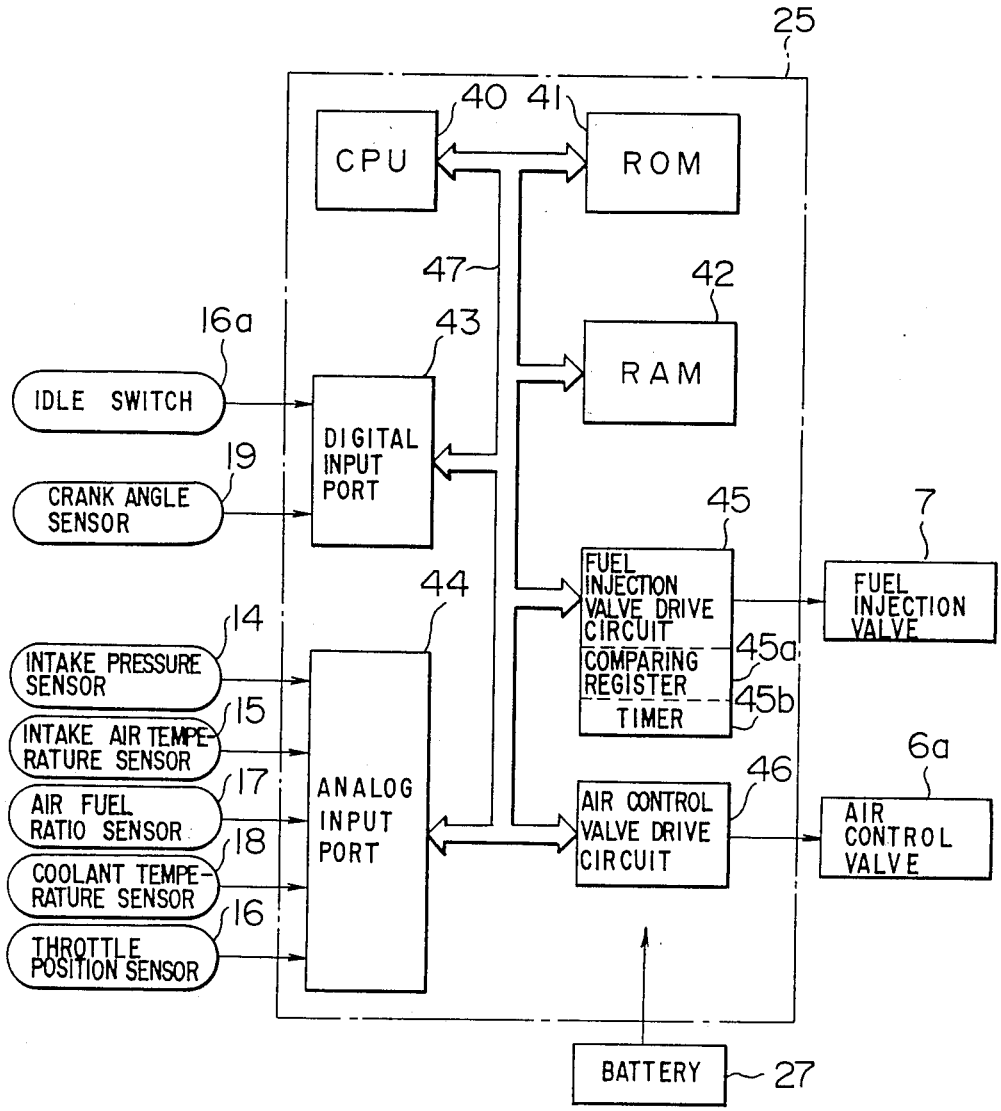
FIG. 2 is a block diagram showing the electronic control unit (ECU) of the engine control system.

FIG. 2 shows in block diagram the arrangement of the ECU 25, which is constructed as an arithmetic-logic operation circuit, with its major components including a well-known CPU 40, ROM 41 and RAM 42. These components are connected through a bus 47 with input-/output ports including a digital input port 43 and analog input port 44 and with an injection valve drive circuit 45 and air control valve drive circuit 46.

The digital input port 43 has the connection with the idle switch 16*a* and crank angle sensor 19, allowing the CPU 40 to read the full-closed state of the throttle valve 2 and the crank angle (the engine revolving speed N is obtained by reading the crank angle consecutively). The analog input port 44 has the connection with the intake pipe pressure sensor 14, intake air temperature sensor 15, throttle position sensor 16, air-fuel ratio sensor 17, and coolant temperature sensor 18, and it also functions to convert the analog output signals from these sensors into digital data. Accordingly, the CPU 40 can read sequentially the intake pipe pressure Pm, intake air temperature Tm, exhaust oxygen concentration $\lambda$, coolant temperature Thw, and throttle opening $\theta$ through the input port 44.

The fuel injection valve drive circuit 45 incorporates a comparing register 45*a* and timer 45*b*, and functions to open the fuel injection valve 7 when the time clocked by the timer 45*b* matches the time which is set in the comparing register 45*a*. The CPU 40 calculates the base injection time length from the intake pipe pressure Pm and engine speed N in synchronism with the engine revolution, modifies the calculated result using a modification value which reflects the intake air temperature Tam, exhaust oxygen concentration $\lambda$, coolant temperature Thw and throttle opening $\theta$ so as to evaluate the effective injection time length, further modifies the result depending on the terminal voltage of the battery 27 to determine the immediate injection time length, and issues a control signal representing the injection time length to the fuel injection valve drive circuit 45. The drive circuit 45 operates on the fuel injection valve 7 to open in response to the control signal, and sets the valve closing time in the comparing register 45*a*. Namely, the fuel injection valve drive circuit 45 holds therein the timing of closing the injection valve 7, and the CPU 40 is free from instructing the valve closure and can concentrate on the global fuel injection control.

The air control valve drive circuit 46 functions to drive the motor associated with the air control valve 6*a* by the amount and direction instructed by the CPU 40, whereby the quantity of intake air to the engine can be increased or decreased during a run as well as in idling.

In the foregoing arrangement of the engine control system, the operation of the ECU for controlling one of the quantity of intake air or quantity of fuel supply, according to the first embodiment of this invention, will be described mainly with reference to the functional block diagram of FIG. 3 and the flowchart of FIGS. 4A and 4B.

Figure 3:
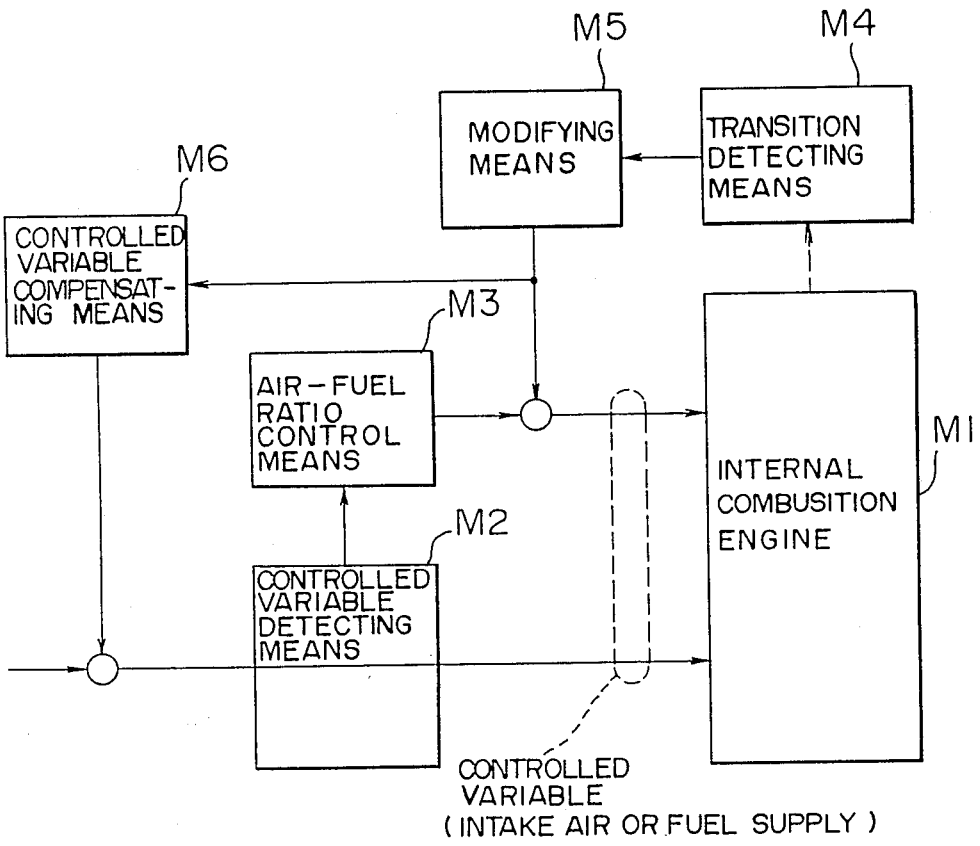
FIG. 3 is a functional block diagram showing the basic arrangement of the first embodiment of this invention.

FIG. 3 shows the functional arrangement of the engine control system according to the first embodiment of the invention. The control system consists of a controlled variable detecting means M2 which measures one of the quantity of intake air or quantity of fuel supply to the internal combustion engine M1, an air-fuel ratio control means M3 which determines, basing on the detected value of the one controlled variable, the base control value used for controlling the other controlled variable, a transition detecting means M4 which detects the transitional change in the operating condition of the engine M1, a modifying means M5 which determines the modification value for adjusting the base control value basing on the detected transitional change, and a controlled variable compensating means M6 which adjusts the value of the controlled variable detected by the detecting means M2. These means are actually realized by the functions of the ECU 25 and the sensors.

Figure 4B:
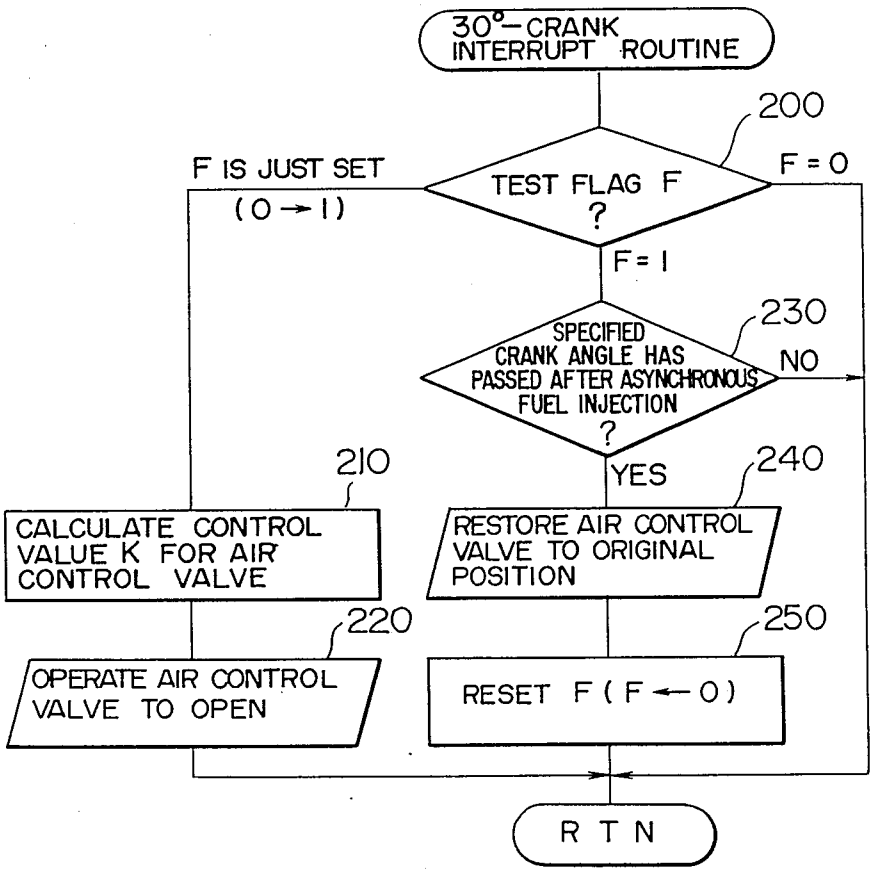
FIGS. 4A and 4B are flowcharts showing interrupt routines executed by the ECU.
Figure 4A:
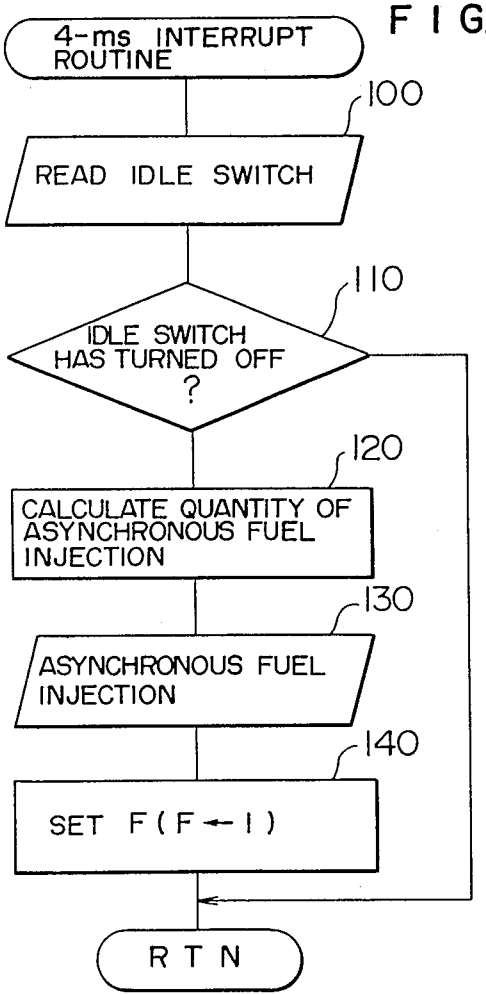

The following describes the operation of the ECU 25 using FIGS. 4A and 4B. In addition to the aforementioned fuel injection control, the ECU 25 executes a 4-millisecond interrupt routine (FIG. 4A) which runs at a 4 ms interval by being triggered by the timer within the CPU 40 and a 30°-crank interrupt routine (FIG. 4B) which runs by being triggered by the pulse signal produced at a 30° interval by the crank angle sensor 19.

Initially, the 4-ms interrupt routine reads the state of the idle switch 16a through the digital input port 43 (step 100), and tests whether the idle switch 16a has made a transition from ON (throttle valve full-closed) to OFF (throttle valve not full-closed) by comparison with the previous state (step 110). If the idle switch 16a has changed from ON to OFF, indicating that the throttle valve 2 has been operated to open from full-closed, the routine calculates the quantity of asynchronous fuel injection in anticipation of start-up of the vehicle (step 120) and operates on the injection valve drive circuit 45 to activate the fuel injection valve 7, thereby immediately carrying out the asynchronous fuel injection (step 130). Then, the routine sets a flag F which indicates the completion of asynchronous fuel injection, and terminates the process at RTN.

Figure 5:
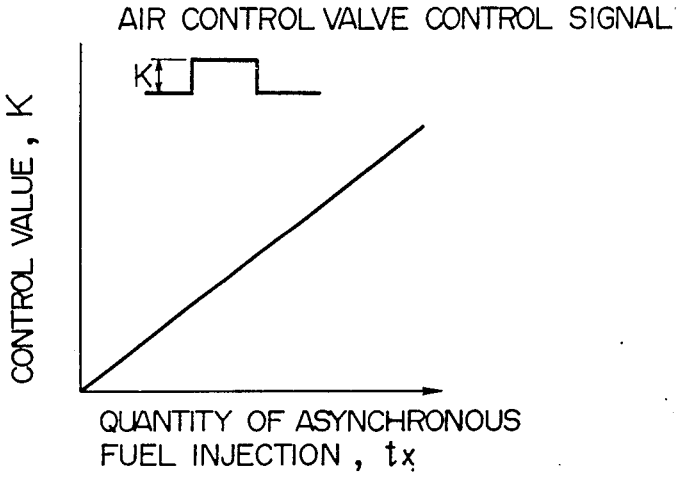
FIG. 5 is a graph showing the relation between the quantity of asynchronous fuel injection and the control value K of the air control valve.

The 30°-crank interrupt routine initially tests the flag F (step 200). If the flag F has made a change from reset to set as compared with the state at the previous execution of the routine, it implements the calculation for the control value K of the air control valve 6a (step 210) and operates on the air control valve drive circuit 46 to open the air control valve 6a in compliance with the control value K (step 220) so that the quantity of intake air increases. The control value K for the air control valve 6a may be determined depending on the quantity of asynchronous fuel injection (asynchronous injection time length tx) as shown in FIG. 5, or may be a predetermined constant value. In consequence, the intake air increases, and even if the air-fuel ratio is about to go over-rich as a result of the asynchronous fuel injection, it is compensated by the operation of the air control valve 6a, and the mixture air-fuel ratio does not go out of the favorable range A on the graph of FIG. 6.

Figure 7:
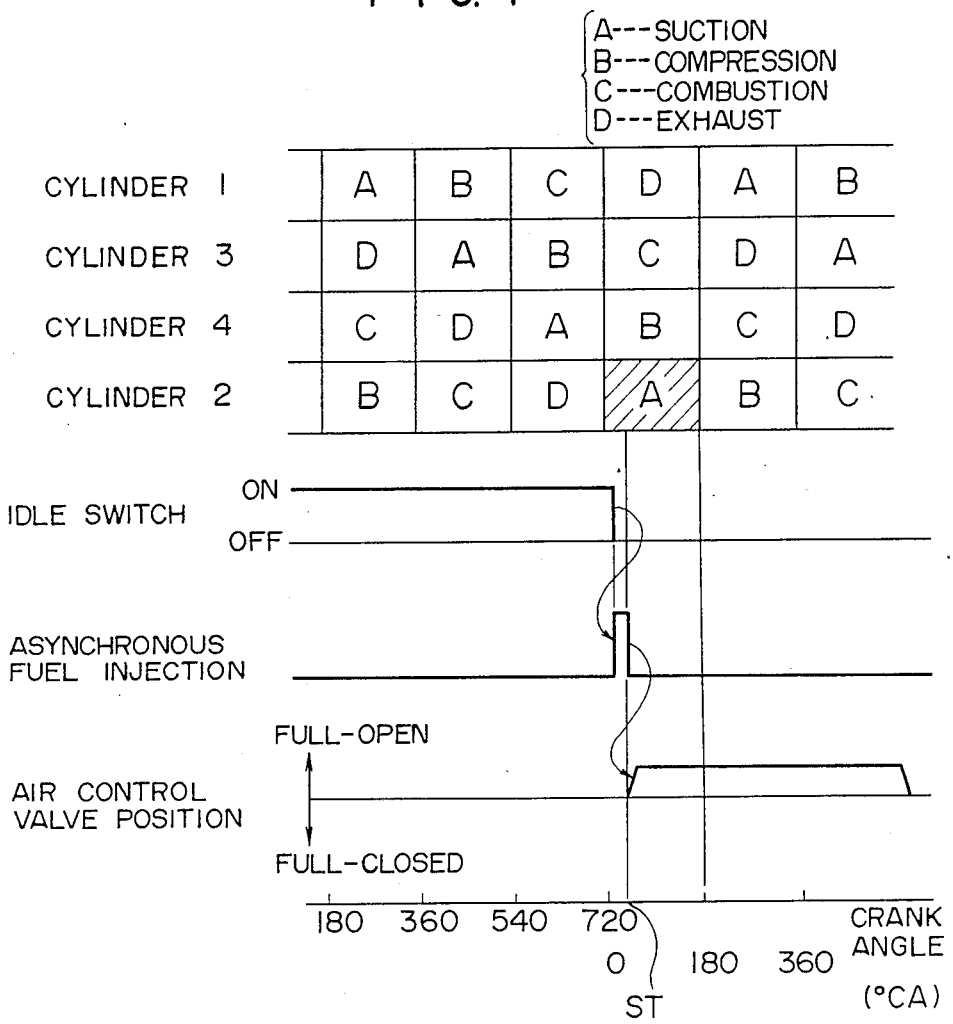
FIG. 7 is a timing chart used to explain the control operation carried out by the first embodiment of this invention.

If, on the other hand, the flag F is found set continuously in step 200, the routine tests whether the crankshaft has rotated by a certain amount of crank angle from the position at the implementation of asynchronous fuel injection (step 230). If the specified crank angle interval has not yet passed, no process follows as in the case of a reset flag F. The specified crank angle interval is predetermined from the time length in which adverse effects of asynchronous fuel injection are cleared, and it is equivalently about three-stroke length, for example, as shown in FIG. 7.

If, on the other hand, the specified crank angle interval has already passed, the routine implements the process for restoring the air control valve 6a to the position before the control of step 220 has taken place (step 240), and after resetting the flag F (step 250) it terminates the process at RTN.

Figure 8:
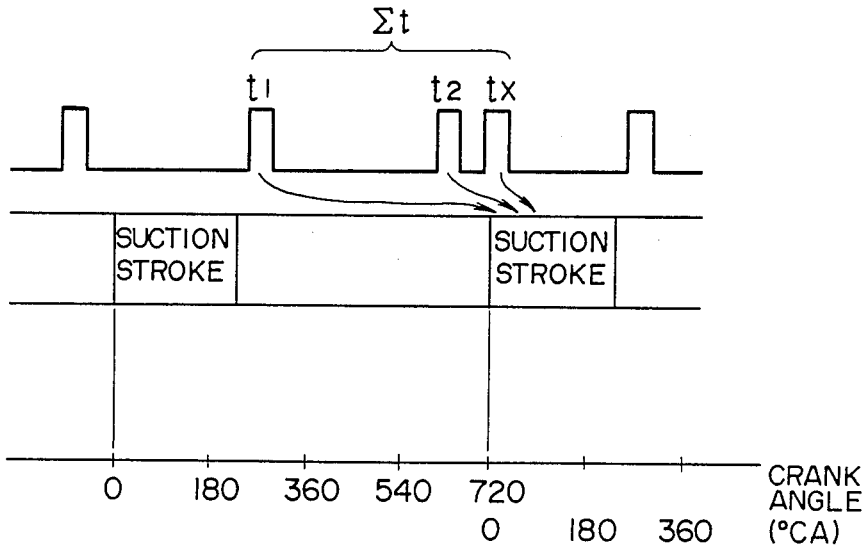
FIG. 8 is a graph showing the relation between the quantity of fuel injection and the suction stroke according to the first embodiment of the invention.

According to the engine control system of this embodiment, when the idle switch 16a operates to indicate that the throttle valve is opened from its full-closed position, the fuel supply is increased by asynchronous fuel injection (asynchronous fuel injection pulse tx in FIG. 8) in anticipation of start-up of the vehicle and at the same time the air control valve 6a is opened by the specified degree K so that the quantity of intake air is increased during the specified crank angle interval. Accordingly, even in case the driver applies the accelerator slightly during the engine idling state, the mixture is prevented from being an over-rich air-fuel ratio which would incur a falling engine output and eventually engine stall. Since intake air increases to match with the asynchronous fuel injection, causing the engine output to increase, it does not disturb the feeling of the driver who has operated the accelerator, and in addition it mends a worse situation of exhaust quality. In the case of a deep accelerator operation at start-up, the throttle valve 2 opens to increase intake air, and the following asynchronous fuel injection produces an increased engine output, whereby the vehicle can start smoothly without hesitation.

Although in the foregoing embodiment of the invention it has been simply described that the air control valve 6a is driven by a motor, it may employ a well known idle speed control valve using, for example, a stepping motor, linear solenoid, rotary solenoid, or vacuum switching valve. The air control valve 6a may have its open duration controlled on the time axis, instead of the crank angle.

The present invention is not confined to the foregoing embodiment, but various other forms of practice are possible. For example, the air control valve for adjusting the quantity of intake air may be replaced with a throttle valve which is subsidiarily operated by a throttle actuator such as an electric motor, or the inventive engine control system can also be applied to the fuel priority system in which the quantity of intake air is determined depending on the quantity of fuel which has been determined in advance.

Next, the operation of the ECU for controlling the mixture air-fuel ratio by regulating the quantity of fuel supply, according to the second embodiment of this invention, will be described using mainly the functional block diagram of FIG. 9 and the flowchart of FIG. 10.

Figure 9:
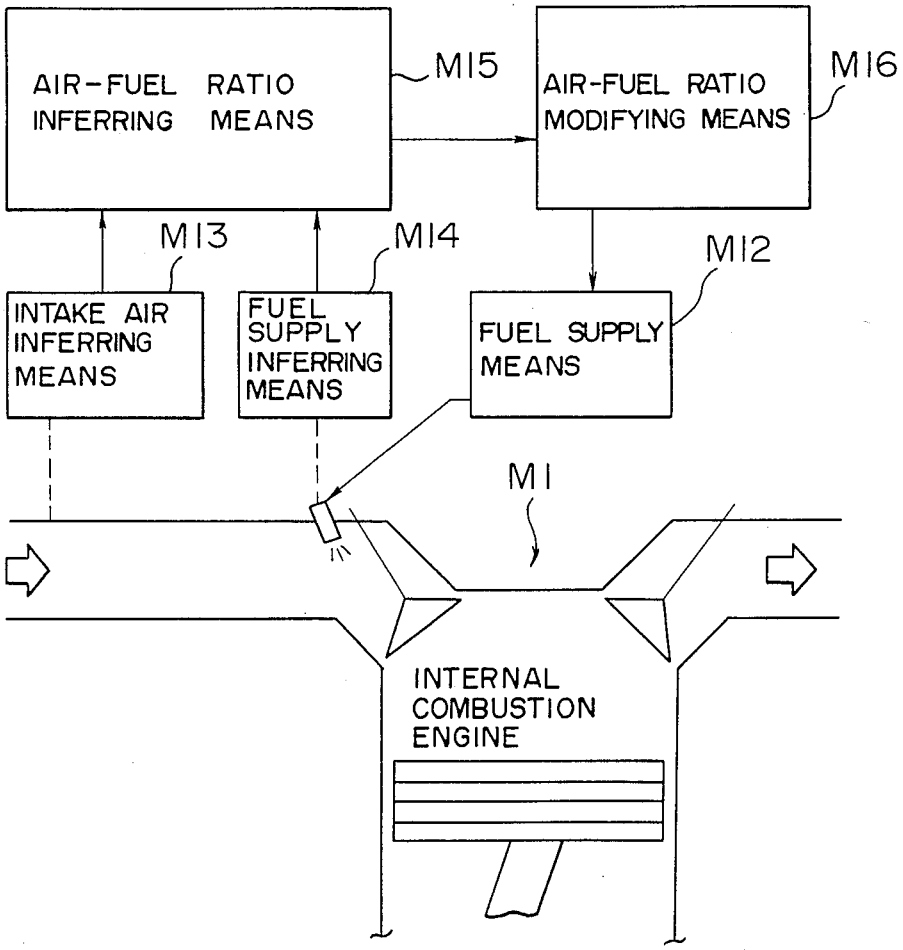
FIG. 9 is a functional block diagram showing the arrangement of the second embodiment of this invention.

FIG. 9 shows the functional arrangement of the engine control system according to the second embodiment of the invention. The control system consists of a fuel supply means M12 which supplies the fuel to the internal combustion engine M1, an intake air inferring means M13 which infers the quantity of air taken in a cylinder of the engine, a fuel supply inferring means M14 which infers the quantity of fuel supplied to the cylinder, an air-fuel ratio inferring means M15 which infers the air-fuel ratio of the mixture in the cylinder basing on the inferred quantities of air and fuel, and an air-fuel ratio modifying means M16 which operates on the fuel supply means M12 in accordance with the inferred air-fuel ratio to adjust the quantity of fuel delivered to the cylinder so that the air-fuel ratio is maintained within the prescribed range. These means are actually realized by the functions of the ECU 25 and the sensors.

Figure 10:
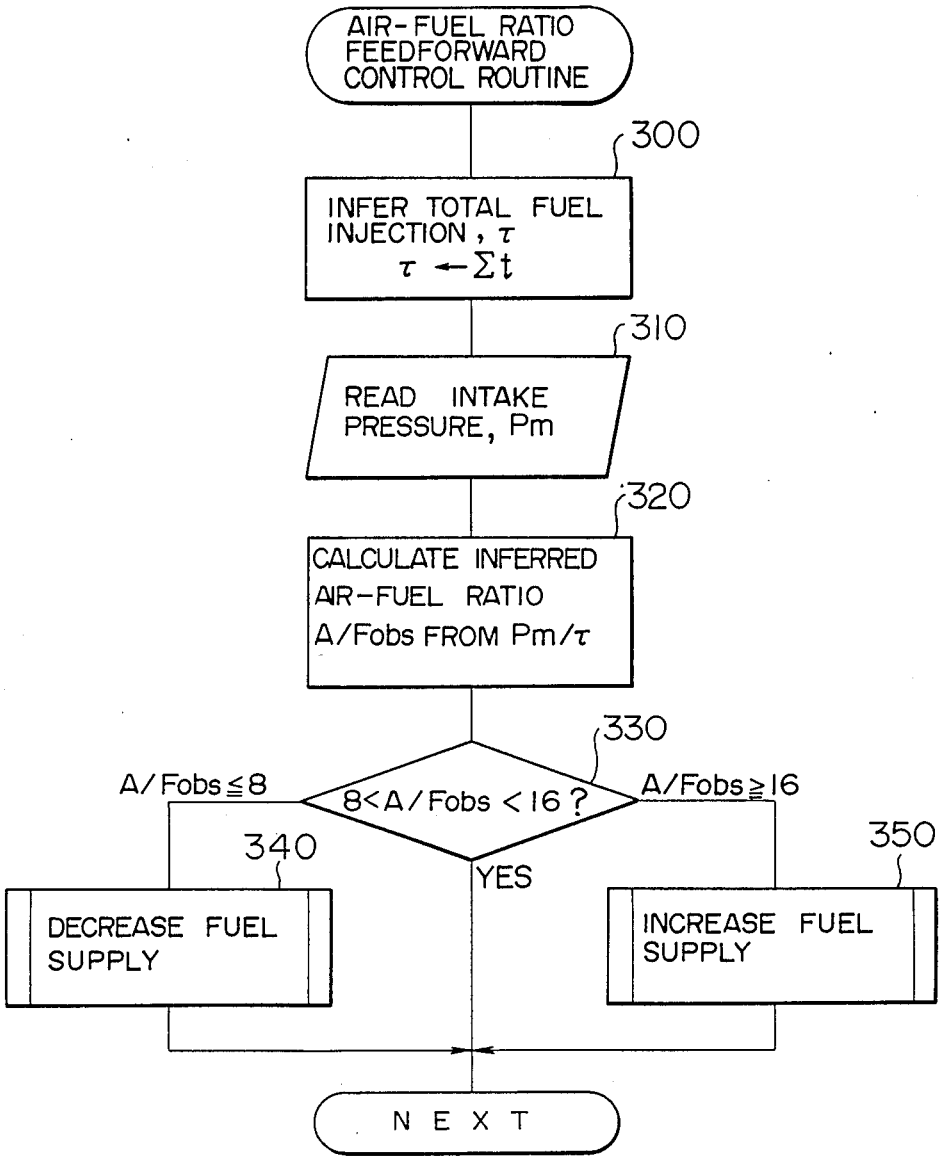
FIG. 10 is a flowchart showing the air-fuel ratio feed-forward control routine executed by the ECU according to the second embodiment of the invention.

The following describes the operation of the ECU 25 using FIG. 10. In addition to the known fuel injection control, the ECU 25 executes the air-fuel ratio feed-forward control routine shown in FIG. 10. This control routine is executed for each cylinder a certain interval after the suction stroke has begun (at timing ST shown in FIG. 11).

Figure 11:
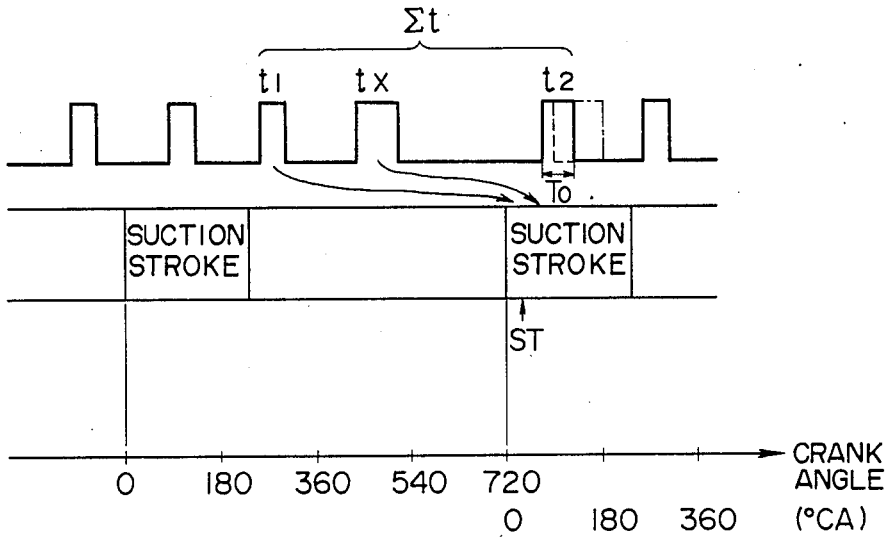
FIG. 11 is a graph used to explain the evaluation of the total quantity of fuel injection $\tau$.

Initially, the routine implements the process for inferring the total quantity $\tau$ of fuel taken in the cylinder (step 300). The inferring process is done by summing the quantity of fuel which has been injected after the previous suction stroke has ended until the current time point for that cylinder and the specified quantity of fuel which is preset as a reference quantity to be injected during the execution of this routine and determined as a result of execution of the routine. Specifically, the inference process is based on the fact that the quantity of fuel injection is proportional to the effective injection pulse width t applied to the fuel injection valve 7, and it sums the effective injection pulse widths t1 and t2 during synchronous fuel injections and the effective injection pulse width tx during synchronous fuel injection, as shown in FIG. 11. The effective injection pulse width t2 is given the value TO corresponding to the prescribed quantity of fuel. The inferred fuel injection value $\tau$ is stored in a certain location of the RAM 42.

Subsequently, the routine reads through the analog input port 44 the intake pipe pressure Pm provided by the sensor 14 in order to make inference for the quantity of air taken by the cylinder (step 310). The charging efficiency of the mixture in the cylinder of an internal combustion engine is determined dominantly by the intake pipe pressure Pm, and therefore the total quantity of intake air can be inferred from the intake pipe pressure Pm at a certain time point before the end of the suction stroke. When a sensor for measuring the mass Ga of intake air in unit time length, as disclosed, for example, in U.S. Pat. No. 3,975,951, is employed, corresponding to the time length needed for the suction stroke can be used practically for the inference of the total quantity of intake air in terms of Ga/N.

In the subsequent step 320, the routine calculates the inferred air-fuel ratio A/Fobs through the division operation for the intake pipe pressure Pm which represents the inferred total intake air, that has been read in step 310, by the total fuel supply $\tau$ which has been inferred in step 310. The inferred air-fuel ratio A/Fobs is evaluated by inference, before the end of the suction stroke, as an air-fuel ratio of the mixture contributive to the combustion following the suction stroke. Namely, the inferred air-fuel ratio A/Fobs enables to estimate the mixture air-fuel ratio without waiting for the detection of the oxygen concentration in the exhaust gas which will be revealed after combustion.

Figure 12A:
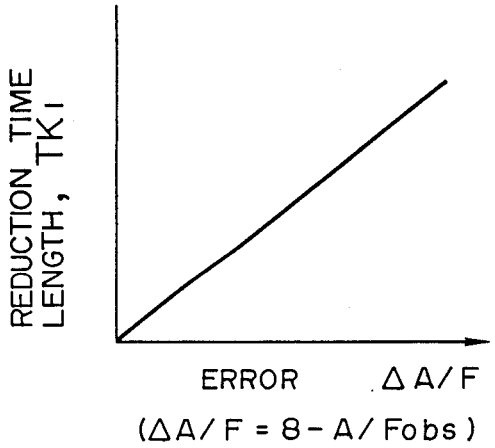
FIGS. 12A and 12B are graphs showing the relation between the error of air-fuel ratio and the pulse width reduction TK1 for the fuel injection pulse, and the relation between the error of air-fuel ratio and the pulse width expantion TK2 for the fuel injection pulse.

Step 330 tests the value of A/Bobs, and if it is "8" or smaller the sequence proceeds to the process for decreasing the fuel supply (step 340), or if it is "16" or greater the sequence proceeds to the process for increasing the fuel supply (step 350). Namely, in step 340 the mixture is over-rich which would result in an impaired engine output or even engine stall, as shown by region B of FIG. 6, and therefore the routine operates on the fuel injection valve drive circuit 45 to reduce the effective synchronous injection pulse width t2 from the specified value TO as shown by the dashed line in FIG. 11 so that the fuel supply decreases. The effective injection pulse width t2 is reduced from the specified value TO by the amount of TK1, which is predetermined in relation with error ΔA/F that is the result of subtraction for the value "8" used in the discrimination of inferred air-fuel ratio A/Fobs by the value of A/Fobs, as shown in FIG. 12A, and is preset in the ROM 41.

Figure 6:
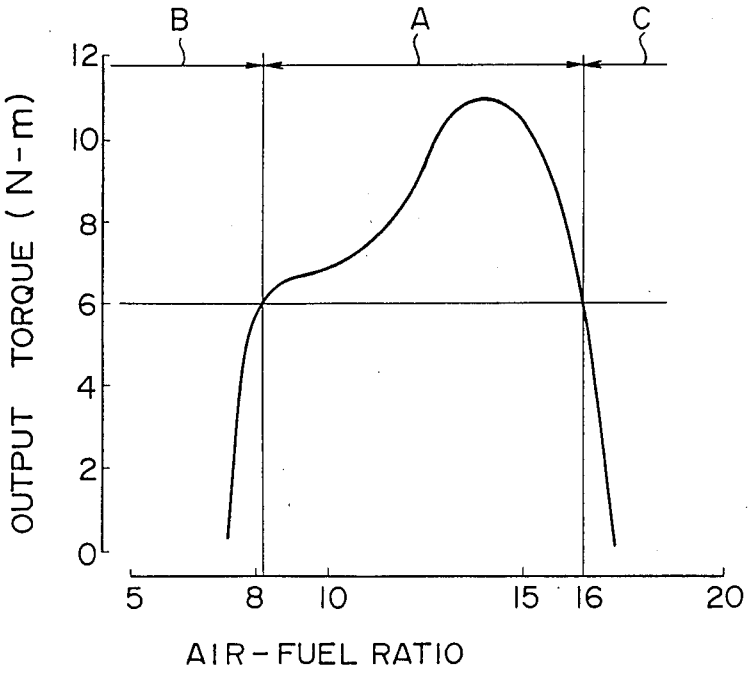
FIG. 6 is a graph showing the relation between the air-fuel ratio and the engine output torque.

The step 350 is for an over-lean mixture which implies an impaired engine output as shown by region C in FIG. 6, and the routine extends the effective injection pulse width t2 by the amount of TK2 as shown by the dash-dot line in FIG. 11 using the relation (FIG. 12B) stored in the ROM 41, so that the fuel supply increases, in contrast to the case of the step 340. In case the inferred air-fuel ratio A/Fobs resides between the values "8[ and "16" (region A in FIG. 6), no modification control takes place for fuel supply, and the routine terminates at NEXT. Although in FIGS. 12A and 12B the values of ΔA/F and TK1 or TK2 are in a linear relation, this is merely one example, and they may have a nonlinear relation depending on the injection device used.

Through the foregoing control process, the mixture air-fuel ratio is inferred at a certain time point after the suction stroke has begun. In case the inferred air-fuel ratio A/Fobs is out of the preset range (between "8" and "16") due to the exertion of synchronous fuel injection or the like, the fuel injection valve 7 is controlled immediately to thereby modulate the fuel supply, and the air-fuel ratio of the mixture in the cylinder will be brought back to the specified range until the end of the suction stroke. Consequently, the problem of over-rich mixture and thus impaired engine output due to an improper synchronous fuel injection, which can occur for example when the driver slightly applies the accelerator in the idling state, can be solved completely. In other words, the engine control system of this embodiment performs a feedforward control for the mixture air-fuel ratio before combustion, whereas conventionally it had to be done late after detecting the exhaust oxygen concentration λ following combustion. This control scheme prevents the alleviation of performance of the internal combustion engine, especially at the transition of operating condition, and at the same time it alleviates the toxity of exhaust gas. In addition, it becomes possible to prevent the disturbance of air-fuel ratio caused by asynchronous fuel injection in the idling state, and therefore to prevent unpleasant sag and stall from occurring.

Since, in this embodiment, the mixture air-fuel ratio is maintained within the prescribed range by the control routine independent of fuel metering control, asynchronous fuel injection for improving the performance of acceleration can be practiced without the fear of deviation from the proper range of air-fuel ratio, whereby the enhancement of operational performance based on fuel injection control can fully be exerted.

Figure 12B:
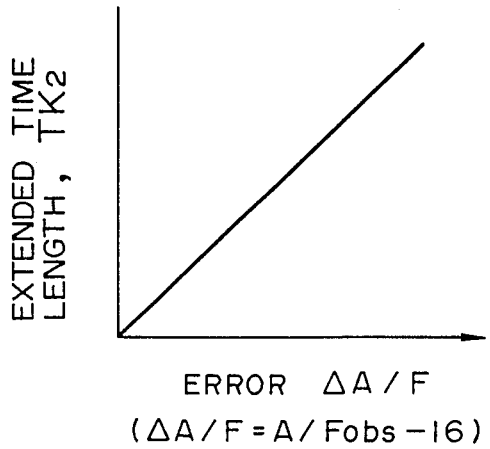

While an embodiment of invention has been described, the present invention is not confined to it, but various other forms of practice are possible, such as the arrangement of carrying out asynchronous fuel injection during the suction stroke after the execution of the control routine, instead of extending the effective injection pulse width by the fuel injection valve drive circuit, or the arrangement of switching or altering the thresholds of inferred air-fuel ratio A/Fobs or the functional relations between ΔA/F and TK1 and between AA/F and TK2 shown in FIGS. 12A and 12B depending on the operational state of the engine (e.g., coolant temperature Thw and engine speed N).

Finally, the operation of the ECU for controlling the mixture air-fuel ratio by adjusting the quantity of intake air, according to the third embodiment of this invention, will be described using mainly the functional block diagram of FIG. 13 and the flowchart of FIG. 14.

Figure 13:
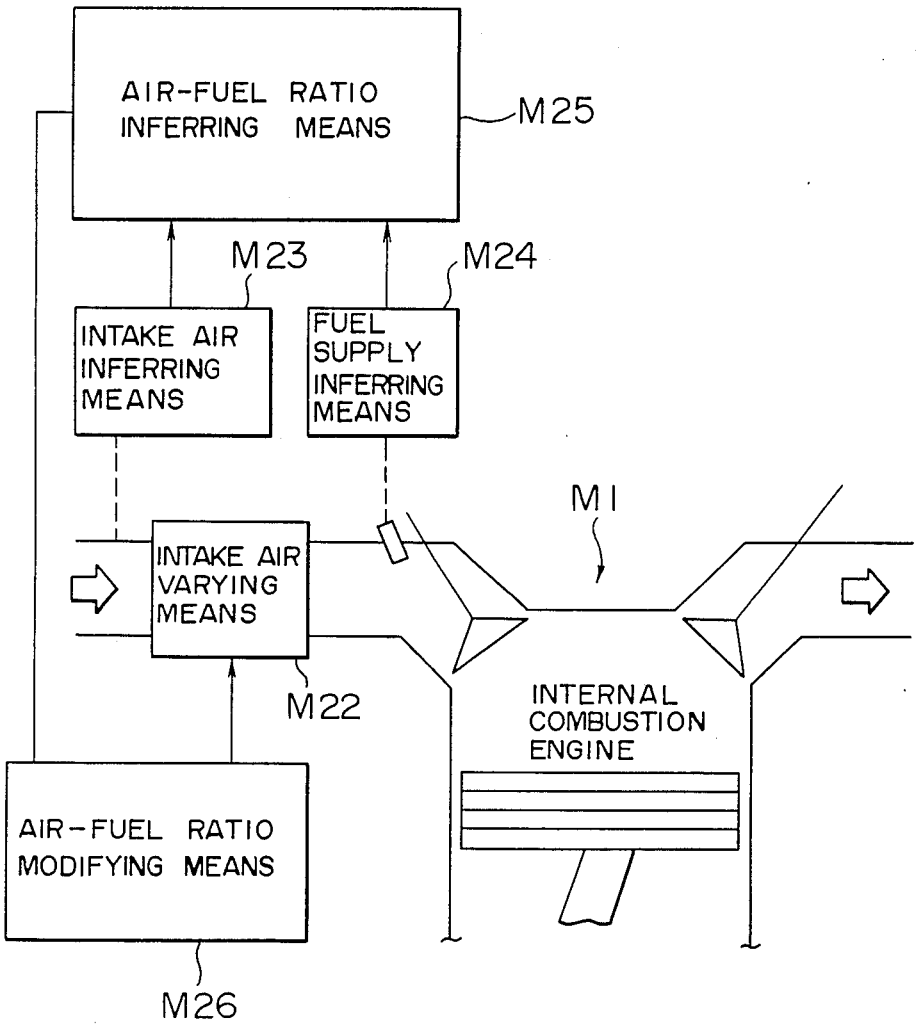
FIG. 13 is a functional block diagram showing the arrangement of the third embodiment of this invention.

FIG. 13 shows the functional arrangement of the engine control system according to the third embodiment of the invention, and it consists of an intake air varying means M22 which varies the quantity of intake air introduced to the internal combustion engine M1, an intake air inferring means M23 which infers the quantity of air taken in a cylinder, a fuel inferring means M24 which infers the quantity of fuel delivered to the cylinder, an air-fuel ratio inferring means M25 which infers the air-fuel ratio of the mixture in the cylinder basing on the inferred quantities of air and fuel, and an air-fuel ratio modifying means M26 which operates on the intake air varying means M22 in accordance with the inferred air-fuel ratio to adjust the quantity of air introduced to the cylinder so that the mixture air-fuel ratio is maintained within the prescribed range. These functional means are actually realized by the functions of the ECU 25 and the sensors.

Figure 14:
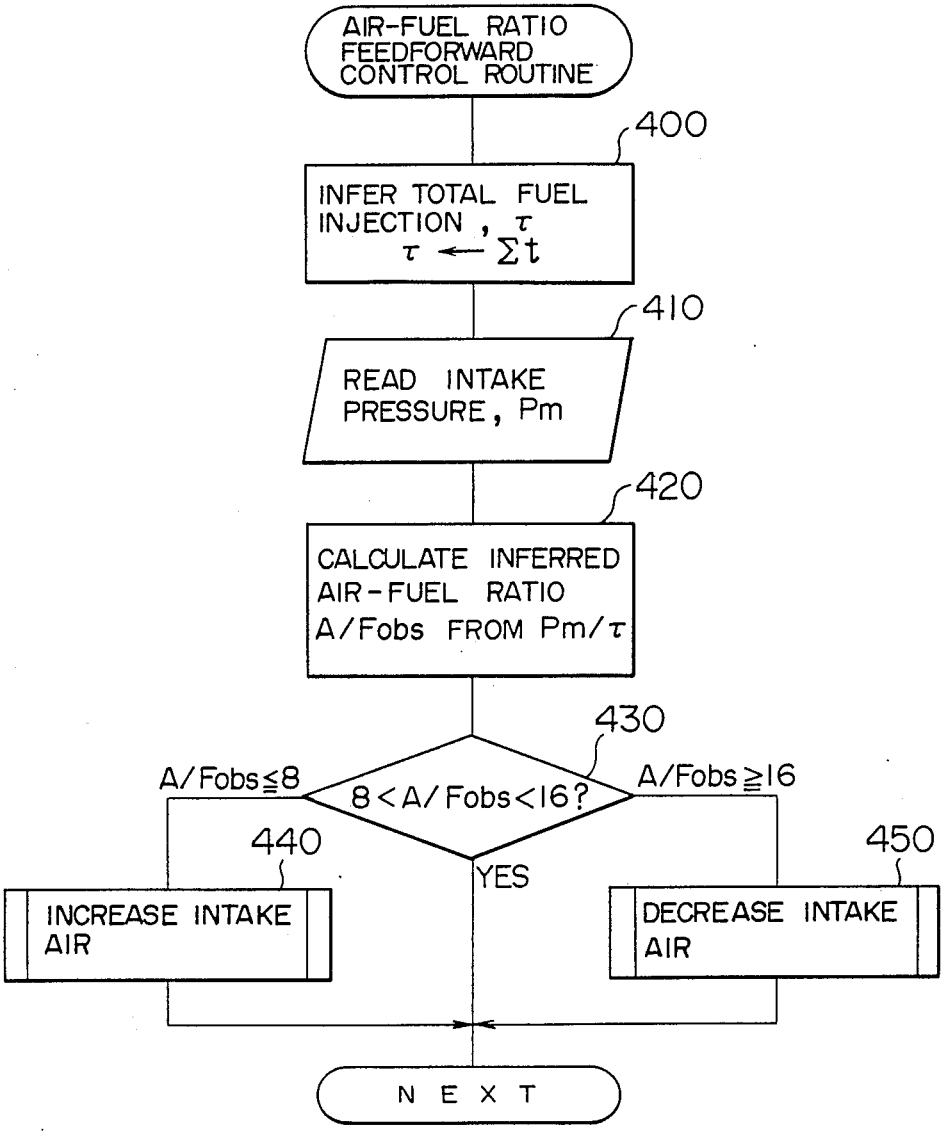
FIG. 14 is a flowchart showing the air-fuel ratio feed-forward control routine executed by the ECU according to the third embodiment of the invention.

The following describes the operation of the ECU 25 using FIG. 14. In addition to the well known fuel metering control, the ECU 25 executes an air-fuel ratio feedforward control routine shown in FIG. 14. This routine is executed at a certain time interval after the suction stroke has begun.

Figure 15:
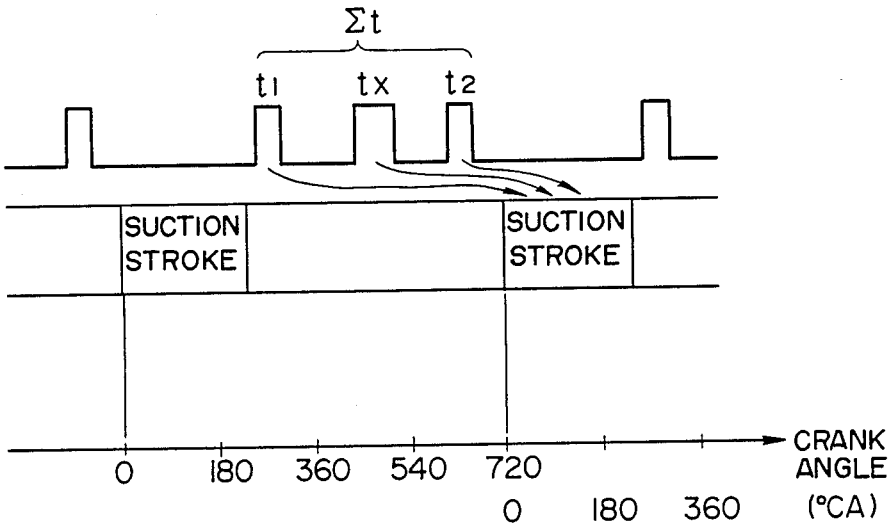
FIG. 15 is a diagram used to explain the evaluation of the total quantity of fuel injection $\tau$ according to the third embodiment of the invention.

Initially, the routine implements the process total quantity $\tau$ of fuel taken in the cylinder (step 400). The inference of the total fuel $\tau$ is based on the summation of injected fuel after the previous suction stroke has ended until the current time point for the cylinder. Specifically, the inference process is based on the fact that the quantity of fuel injection is proportional to the effective injection pulse width t applied to the fuel injection valve 7, and it sums the effective injection pulse widths t1 and t2 during synchronous fuel injections and the effective injection pulse width tx during synchronous fuel injection, as shown in FIG. 15. The inferred fuel injection value $\tau$ is stored in a certain location of the RAM 42.

Subsequently, the routine reads the intake pipe pressure Pm provided by the sensor 14 through the analog input port 44 in order to make inference for the quantity of air taken in the cylinder (step 410). The charging efficiency of the mixture in the cylinder of an internal combustion engine is determined dominantly by the intake pipe pressure Pm, and therefore the total quantity of intake air can be inferred from the intake pipe pressure Pm at a certain time point before the end of the suction stroke. When a sensor for measuring the mass Ga of intake air in unit time length, as disclosed for example in U.S. Pat. No. 3,975,951, is employed, the value 1/N (where N is the engine revolving speed) corresponding to the time length needed for the suction stroke can be used practically for the inference of the total intake air in terms of Ga/N.

In the subsequent step 420, the routine calculates the inferred air-fuel ratio A/Fobs through the division operation for the intake pipe pressure Pm which has been read in step 410 as an inferred total intake air by the total fuel supply $\tau$ which has been inferred in step 400. The inferred air-fuel ratio A/Fobs is evaluated by inference before the end of the suction stroke as an air-fuel ratio of the mixture contributive to the combustion following the suction stroke. Namely, the inferred air-fuel ratio A/Fobs enables to estimate the mixture air-fuel ratio without waiting for the detection of the exhaust oxygen concentration which will be revealed after combustion.

Figure 16A:
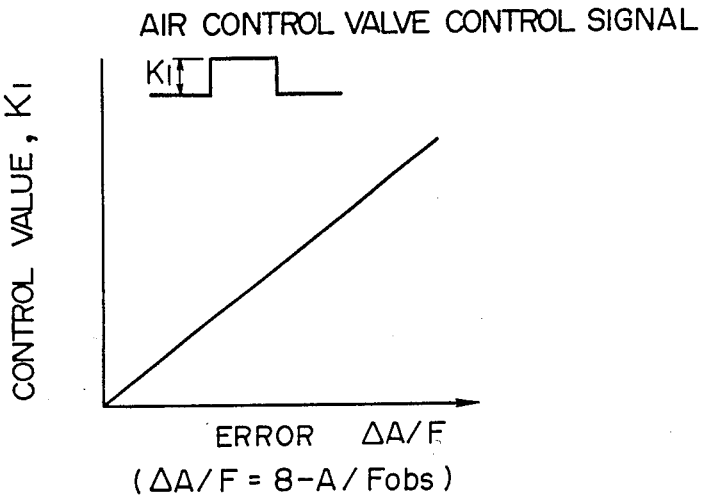
FIGS. 16A and 16B are graphs showing the relation between the error of air-fuel ratio and the control values K1 and K2 of the air control valve.

Step 430 tests the value of A/Fobs, and if it is "8" or smaller the sequence proceeds to the process for increasing the intake air (step 440), or if it is "16" or greater the sequence proceeds to the process for decreasing the intake air (step 450). Namely, in step 440 the mixture is over-rich which would result in an impaired engine output or even engine stall, as shown by region B in FIG. 6, and therefore the routine operates on the air control valve drive circuit 46 to activate the valve 6a, thereby increasing the intake air in the current suction stroke using this additional air path. The air control valve 6a has its control value K1 predetermined in relation with error $\Delta A/F$ resulting from the subtraction for the value "8" used in the discrimination of A/Fobs by the value of A/Fobs, as shown in FIG. 16A, and it is preset in the ROM 41.

The step 450 is for an over-lean mixture which implies an impaired engine output as shown by region C in FIG. 6, and the routine reduces the opening of the air control valve 6a by the amount of control value K2 using the relation (FIG. 16B) stored in the ROM 41 so that intake air will decrease, in contrast to the case of step 440. In case the inferred air-fuel ratio A/Fobs resides between the values "8" and "16" (region A in FIG. 6), no modification control takes place for intake air, and the routine terminates at NEXT. Although in FIGS. 16A and 16B the values of $\Delta A/F$ and K1 or K2 are in a linear relation, this is not limited to those shown, but they may have a nonlinear relation depending on the characteristics of the actuator used and the experimental result for the optimal control values. For example, the control values K1 and K2 may be modified depending on the coolant temperature Thw, engine speed N or intake pipe pressure Pm, or they may have other functional relation.

Figure 17:
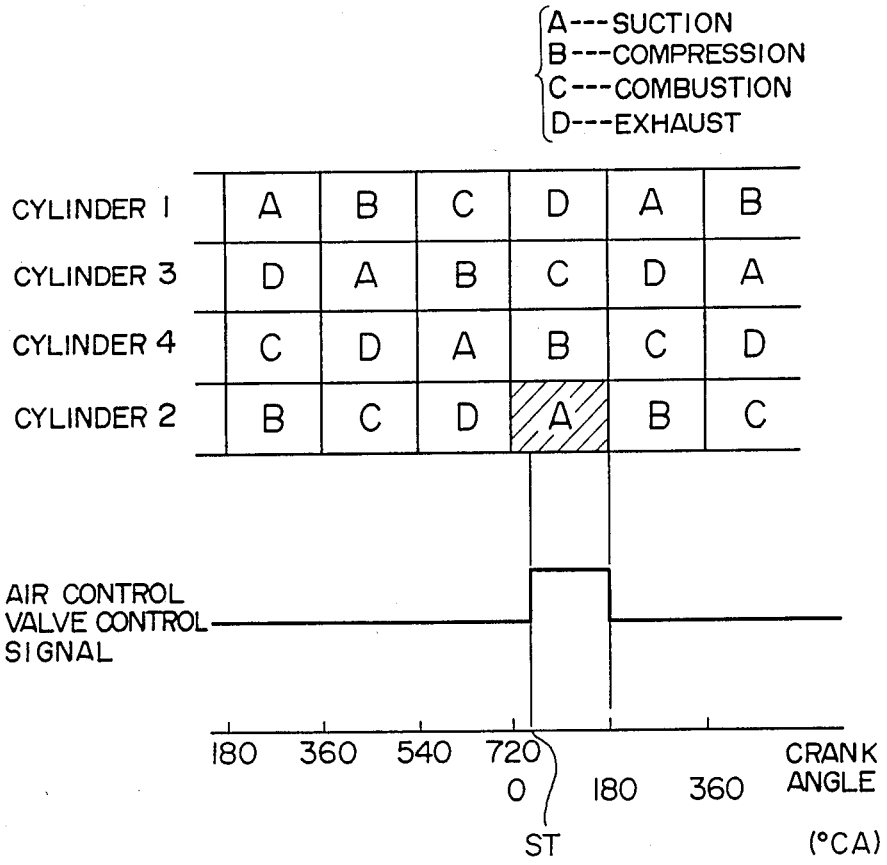
FIG. 17 is a timing chart showing the control operation of the third embodiment of the invention.

Through the foregoing control process, the mixture air-fuel ratio contributive to combustion is inferred at a certain time point after the suction stroke has started, e.g., at time point ST for the second cylinder in FIG. 17. In case the inferred air-fuel ratio A/Fobs is out of the preset range (between "8" and "16") due to the exertion of asynchronous fuel injection or the like, the air control valve 6a is controlled immediately to thereby modulate the intake air, and the air-fuel ratio of the mixture in the cylinder will be brought back to the specified range until the end of the suction stroke. Consequently, the problem of over-rich mixture and thus impaired engine output due to an improper asynchronous fuel injection, which can occur when for example the driver slightly applies the accelerator in the idling state, can be solved completely. In other words, the engine control system of this embodiment performs a feedforward control for the mixture air-fuel ratio before combustion, whereas conventionally it had to be done late after detecting the exhaust oxygen concentration $\lambda$ following combustion. This control scheme prevents the alleviation of performance of the internal combustion engine, especially at the transition of operating condition, and at the same time it alleviates the toxity of the exhaust gas. In addition, it becomes possible to prevent the disturbance of air-fuel ratio caused by asynchronous fuel injection in the idling state, and therefore to prevent unpleasant sag and said from occurring.

Since, in this embodiment, the mixture air-fuel ratio is maintained within the prescribed range by the control routine independent of fuel metering control, asynchronous fuel injection for improving the performance of acceleration can be practiced without the fear of deviation from the proper range of air-fuel ratio, whereby the enhancement of operational performance based on fuel injection control can fully be exerted.

Figure 16B:
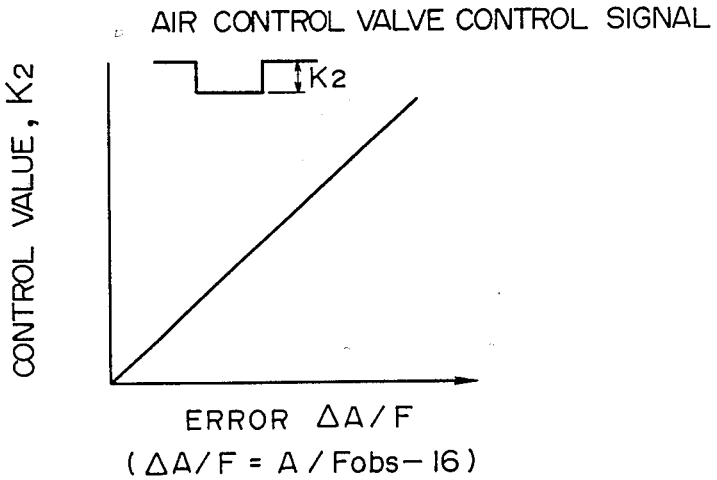

While an embodiment of invention has been described, the present invention is not confined to it, but various other forms of practice are of course possible within the scope of subject matter of this invention, such as the arrangement of adjusting the quantity of intake air by activating a throttle actuator such as an electric motor to move the throttle valve 2, in place of the adjustment of intake air using the air control valve, or the arrangement of switching or altering the thresholds of inferred air-fuel ratio A/Fobs or the characteristics of control values K1 and K2 shown in FIGS. 16A and 16B depending on the operational state of the engine (e.g., coolant temperature Thw and engine speed N).

We claim:

1. An internal combustion engine control system comprising:

controlled variable detecting means which measures one of the quantity of intake air and quantity of fuel supply as a control value reflect the operational state of an internal combustion engine;

air-fuel ratio control means which determines, basing on the measured controlled variable, a base control value used for controlling the other controlled variable;

transition detecting means which detects a transitional change in the operating condition of said engine;

modifying means which determines the value of modification for increasing or decreasing the determined base control value in accordance with the detected transistion; and controlled variable compensating means which increases or decreases in accordance with the determined modification value the control value detect by said controlled variable detecting means, wherein the transitional change detected by said transition detecting means is the acceleration of said engine, and wherein said transition detecting means for detecting the engine acceleration comprises means for detecting that a throttle valve located in an intake pipe of said engine has operated from a full-closed state to an open state.

2. An engine control system according to claim 1, wherein the controlled variable detected by said control variable detecting means is the quantity of intake air taken in said engine, and wherein the base control value determined by said air-fuel ratio control means is a base quantity of fuel determined in dependence of the detected quantity of intake air so that the air-fuel ratio of the mixture supplied to said engine has a predetermined air-fuel ratio.

3. An internal combustion engine control system comprising:

controlled variable detecting means which measures one of the quantity of intake air and quantity of fuel supply as a control value reflect the operational state of an internal combustion engine;

air-fuel ratio control means which determines, basing on the measured controlled variable, a base control value used for controlling the other controlled variable;

transition detecting means which detects a transitional change in the operating condition of said engine;

modifying means which determines the value of modification for increasing or decreasing the determined base control value in accordance wit the detected transistion; and controlled variable compensating means which increases or decreases in accordance with the determined modification value the control value detect by said controlled variable detecting means, wherein the modification value determined by said modifying means is a premium for the base quantity of fuel determined by said air-fuel ratio control means.

4. An internal combustion engine control system comprising:

controlled variable detecting means which measures one of the quantity of intake air and quantity of fuel supply as a control value reflec the operational state of an internal combustion engine;

air-fuel ratio control means which determines, basing on the measured controlled variable , a base control value used for controlling the other controlled variable;

transition detecting means which detects a transitional change in the operating condition of said engine;

modifying means which determines the value of modification for increasing or decreasing the determined base control value in accordance the detected transistion;

controlled variable compensating means which increases or decreases in accordance with the determined modification value the control value detect by said controlled variable detecting means, a fuel injection valve which injects the fuel for said engine;

first fuel supply means which supplies the base quantity of fuel determined by said air-fuel ratio control means to said engine periodically through said fuel injection valve; and second fuel supply means which supplies a premium for said base fuel quantity determined by said modifying means to said engine through said fuel injection valve in response to the detection of engine acceleration by said transition detecting means, independently of the fuel supply by said fir fuel supply means.

5. An internal combustion engine control system comprising:

controlled variable detecting means which measures one of the quantity of intake air and quantity of fuel supply as a control valve reflect the operational state of an internal combustion engine;

air-fuel ratio control means which determines, basing on the measured controlled variable, a base control value used for controlling the other controlled variable;

transition detecting means which detects a transitional change in the operating condition of said engine;

modifying means which determines the value of modification for increasing or decreasing the determined base control value in accordance wit the detected transition; and controlled variable compensating means which increases or decreases in accordance with the determined modification value the control value detect by said controlled variable detecting means, wherein said controlled variable compensating means comprises intake air varying means which varies the quantity of intake air, and intake air compensating means which operates on said intake air varying means to increase the quantity of intake air in accordance with a modification value determine said modifying means.

6. An engine control system according to claim 5, wherein said intake air varying means comprises an electrically operated valve located in an intake pipe of said engine.

7. An internal combustion engine control system for controlling the air-fuel ratio of the mixture taken in an internal combustion engine, said system comprising:

fuel supply means for supplying the fuel to said engine;

intake air inferring means which infers the quantity of air taken is a cylinder of said engine; to fuel inferring means which infers the quantity of fuel supplied said cylinder;

air-fuel ratio inferring means which infers the air-fuel of the mixture in said cylinder basing on the inferred quantities of intake air and fuel; and air-fuel ratio modifying means which operates on said fuel supply means in accordance with the inferred air-fuel ratio so as to increase or decrease the quantity of fuel supplied to said cylinder, thereby maintaining the airratio within a predetermined range, wherein said fuel supply inferring means is designed to infer the quantity of fuel basing on the summation of fuel injection pulses which have been generated after the end of the previous suction stroke until the expiration of a certain time length following the beginning of the next suction stroke.

8. An engine control system according to claim 7, wherein said intake air inferring means comprises an intake pipe pressure detecting means, the quantity of intake air being inferred basing on the intake pipe pressure detected by said pressure detecting means.

9. An engine control system according to claim 7, wherein said intake air inferring means comprises an intake air measuring device, the quantity of intake air being inferred through the calculation in which a value of intake air Ga detected by said measuring device is divided by a value of engine speed N.

10. An engine control system according to claim 7, wherein said air-fuel ratio modifying means comprises air-fuel ratio range modifying means which varies the control range of air-fuel ratio in accordance with the operational state of engine which includes at least one of the engine coolant temperature, engine speed and intake pipe pressure.

11. An engine control system according to claim 7, wherein said air-fuel ratio modifying means comprises air-fuel ratio modifying means which varies the value of increase or decrease of fuel in accordance with the operational state of engine which includes at least one of the engine coolant temperature, engine speed and intake pipe pressure.

12. An internal combustion engine control system for controlling the air-fuel ratio of the mixture taken in an internal combustion engine, said system comprising:

intake air varying means which varies the quantity of intake air to said engine;

intake air inferring means which infers the quantity of air taken in a cylinder of said engine;

fuel inferring means which infers the quantity of fuel supplied to said cylinder;

air-fuel ratio inferring means which infers the air-fuel the mixture in said cylinder basing on the inferred quantities of air and fuel;

air-fuel ratio modifying means which operates on and said intake air varying means in accordance with the inferred air-fuel ratio so that the air ratio is maintained with a predetermined range, wherein said fuel inferring means is designed to infer the quantity of fuel supply basing on the summation of fuel injection pulses which have been generated after the end of the previous suction stroke until the expiration of a certain time length following the beginning of the next suction stroke. been generated after the end of the previous suction stroke until the expiration of a certain time length following the beginning of the next suction stroke.

13. An engine control system according to claim 12, wherein said intake air inferring means comprises intake pipe pressure detecting means, the quantity of intake air being inferred basing on the intake pipe pressure detected by said pressure detecting means.

14. An engine control system according to claim 12, wherein said intake air inferring means comprises intake air metering means for measuring the air quantity within a certain range, the quantity of intake air being inferred through the calculation in which a detected value of intake air Ga is divided by a value of engine speed N.

15. An engine control system according to claim 12, wherein said air-fuel ratio modifying means comprises air-fuel ratio modifying means which varies the control range of air-fuel ratio in accordance with the operational state of engine which includes at least one of the engine coolant temperature, engine speed and intake pipe pressure.

16. An engine control system according to claim 12, wherein said air-fuel ratio modifying means comprises air-fuel modifying means which modifies the control value of an actuator for controlling the quantity of intake air, in accordance with the operational state of engine which includes at one of the engine coolant temperature, engine speed and intake pipe pressure.

* * * * *